United States Patent [19]

Steinhardt et al.

[11] Patent Number: 4,992,064

[45] Date of Patent: Feb. 12, 1991

[54] FLAT CONTACT SPRING FOR PLUGS FOR ELECTRIC PLUG-TYPE CONNECTORS AND PROCESS FOR PRODUCING IT

[75] Inventors: Helmut Steinhardt, Nürnberg; Anton Bieringer, Schwabach, both of Fed. Rep. of Germany

[73] Assignee: TRW Daut & Rietz GmbH & Co. KG, Nuremberg, Fed. Rep. of Germany

[21] Appl. No.: 424,240

[22] PCT Filed: Feb. 11, 1989

[86] PCT No.: PCT/EP89/00127

§ 371 Date: Oct. 16, 1989

§ 102(e) Date: Oct. 16, 1989

[87] PCT Pub. No.: WO89/07846

PCT Pub. Date: Aug. 24, 1989

[30] Foreign Application Priority Data

Feb. 18, 1988 [DE] Fed. Rep. of Germany ..... 3804977

[51] Int. Cl.[5] ..... H01R 13/00

[52] U.S. Cl. ..... 439/845; 439/884

[58] Field of Search ..... 439/816, 825, 845, 849, 439/850, 884, 885, 891

[56] References Cited

U.S. PATENT DOCUMENTS

| | | | |
|---|---|---|---|
| 2,511,806 | 6/1950 | Macy . | |
| 3,017,605 | 1/1962 | Platz et al. | 439/825 |
| 3,400,358 | 9/1968 | Byrnes et al. | 439/825 |
| 4,030,804 | 6/1977 | Enomoto . | |
| 4,413,873 | 11/1983 | Karl | 439/849 |
| 4,691,981 | 9/1987 | Coldren | 439/849 |
| 4,764,133 | 8/1988 | Kaneko | 439/845 |

FOREIGN PATENT DOCUMENTS

| | | |
|---|---|---|
| A1 2516423 | 10/1976 | Denmark . |
| A1 2925938 | 1/1980 | Denmark . |

*Primary Examiner*—Joseph H. McGlynn

*Attorney, Agent, or Firm*—Collard, Roe & Galgano

[57] ABSTRACT

The invention relates to a flat contact spring for plugs of electric plug connectors with socket bodies having socket contacts.

7 Claims, 1 Drawing Sheet

FLAT CONTACT SPRING FOR PLUGS FOR ELECTRIC PLUG-TYPE CONNECTORS AND PROCESS FOR PRODUCING IT

The invention relates to a flat contact spring for plugs of electric plug connectors with socket bodies having socket contacts.

The known flat contact springs for plugs are formed by plane sheet metal cut to size, whereby a contact spring tongue, the latter being pluggable in the socket contact of a socket body, is linked up with crimp attachments for fixing the electric connection cables and their insulation. With the known flat contact springs, the contact spring tongue is formed by a relatively thick metal sheet material as a solid body. Aside from the fact that thick metal sheet sections are difficult to cut, adaptation of the thickness of the contact spring tongue to the inside diameter of the openings of socket contact can be accomplished only by using more or less thick metal sheet materials. In addition, the contact spring tongues so formed have a very low bending moment, which means they are often unintentionally buckled, which has an unfavorable bearing on the plugging processes of such flat contact springs.

The problem of the invention is to make the cutting process safer with flat contact springs and to create simple measures for increasing the stability and adaptation of the contact spring tongue to the inside diameter of the openings of socket contacts.

According to the invention, said problem is resolved by means of a metal sheet cut having a center strip and crimp attachments embodied with an axial spacing from said center strip, as well as lateral strips arranged on both sides of the center strip, said side strips being foldable onto the latter and having substantially half of the width of the center strip.

By doubling the flat contact spring within the zone of the contact spring tongue it is now possible to use a thin metal sheet material that can be easily cut, while the bending edges of the lateral strips lead to prestrengthening.

In the embodiment of the contact spring, the center strip has two impressions extending parallel next to each other in the longitudinal direction, and each of the lateral strips has the same impression, in a way such that when the lateral strips are folded against the center strip, the impressions of the latter and of the lateral strips are disposed on top of each other, in each case forming chambers which are closed all around. By selecting suitable depths for the impressions, the latter permit adaptation of the contact spring tongue to any thickness, and the bending moment is increased by the boundary surfaces of the impressions, said surfaces extending transversely to the plane of the contact spring tongues, which prevents buckling of the contact spring tongue and wrong plugging caused by such deformation.

Furthermore, provision is made that the center strip and the two lateral strips have bevels on the outside of the free ends, such bevels extending sloped relative to each other. Such bevels may be produced by grinding or noncutting deformation, for example by pressing, forming blades linked up with bevelled surfaces between the center strip and the lateral strips folded onto the latter, which bevelled surfaces facilitate the insertion of the contact spring tongue in socket contacts.

It is understood that the lateral strips may be freely folded onto the center strip. However, according to a preferred embodiment, the free ends of the center and lateral strips are rigidly joined with each other, for example by welding, soldering or glueing. Such rigid connection is usefully produced within the zone of the common plane of separation of the two lateral strips. Such fixing of the strip parts on each other prevents undesirable buckling or bending of said strip parts.

Finally, provision is made that an edge strip is cut on the metal sheet cut at the end facing the crimp attachments, said edge strip having additional metal sheet cuts arranged thereon. The edge strip facilitates the handling of the metal sheet cuts especially across the duration of the stamping and bending operations, or of other treatments, for example galvanic metal depositing. The flat contact springs are freely available after they have been separated from the edge strip.

Provision is made for the following process steps for manufacturing the flat contact springs: a center strip with crimpable attachments and two lateral strips are cut from a flat metal sheet material; the center strip and the lateral strips are stamped to produce their impressions; the two lateral strips are folded onto the center strip; furthermore, the center strip and the lateral strips are bevelled at their free ends and rigidly joined with each other and with the center strip; the crimp attachments are bent up; and the metal sheet cut is separated from the edge strip.

The invention is explained in greater detail by reference to an embodiment shown in the drawing, in which.

Figure 6:
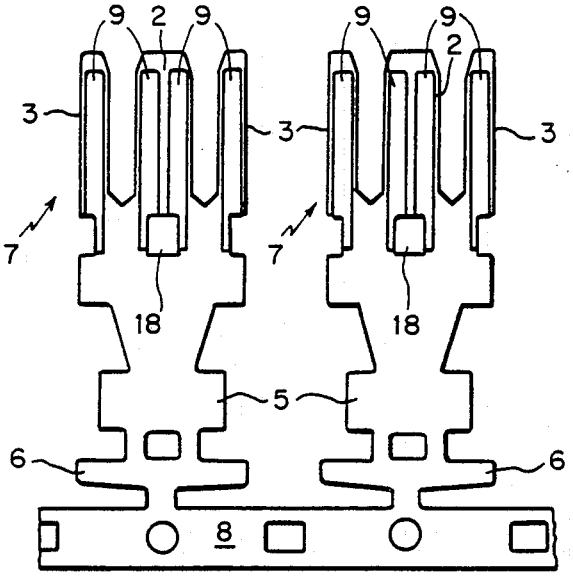
FIG. 6 shows a top view of a metal sheet cut to size for a flat contact spring.

Reference numeral 1 denotes a flat contact spring having a center strip 2 and a lateral strip 3 on each side of the latter, said lateral strip having half the width of the center strip. FIG. 6 shows that the two lateral strips 3 and the center strip 2 are commonly formed with the crimp attachments 5 and 6 by a plane metal sheet 7 cut to size. The latter is cut with the additional metal sheet cuts 7 on an edge strip 8.

Figure 8:
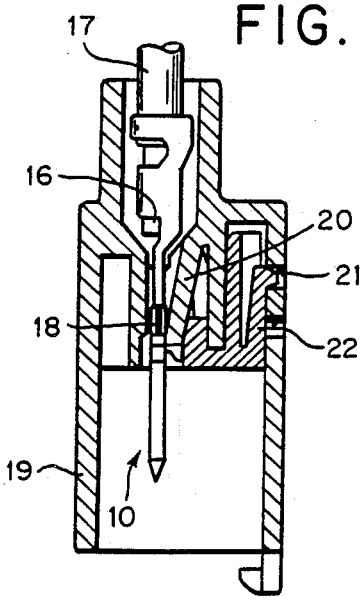
FIG. 8 shows a sectional view of a plug casing with a flat contact spring.

In the embodiment shown by way of example, the center strip 2 has the two parallel impressions 9, whereas each of the two lateral strips 3 has an identical impression 9. The depth of the impressions 9 may vary in predetermined ways depending on the variation in thickness of the contact spring tongue 10. The two lateral strips 3 are foldable against the center strip 2. When folded against the latter, the impressions 9 of the center strip 2 and the lateral strips 3 come to rest on top of each other, forming the chambers 11. The lateral boundaries of the chambers 11 and the bending edges 12 lead to a strengthening of the contact spring tongue 10 and increase the bending moment of the latter. At their plugging ends, the center strip 2 and the lateral strips 3 have the bevels 13. When the lateral strips 3 are folded against the center strip 2, said bevels jointly form a blade 14 linked up with the bevelled surfaces 15. The blade 14 and the bevelled surfaces 15 facilitate the plugging of the flat contact spring in socket contacts (not shown). When or as the flat contact spring is being plugged, the bevelled surfaces lead to an automatic centering of the contact spring tongue 10. The crimp attachments 5 are suitable for fixing the electrical leads 16 by bending them up or over (FIG. 8), whereas the crimp attachments 6 serve for fixing the insulation 17 of the electrical leads 16.

Figure 1:
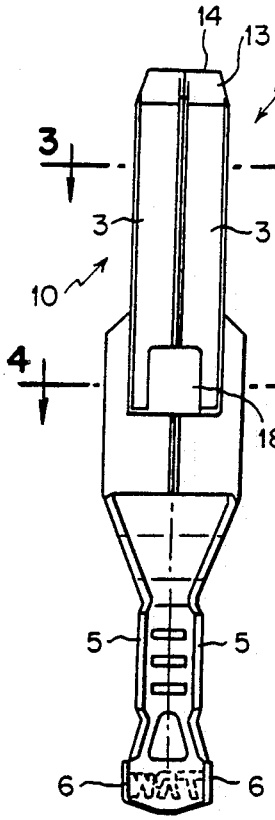
FIG. 1 shows a top view of a flat contact spring.
Figure 2:
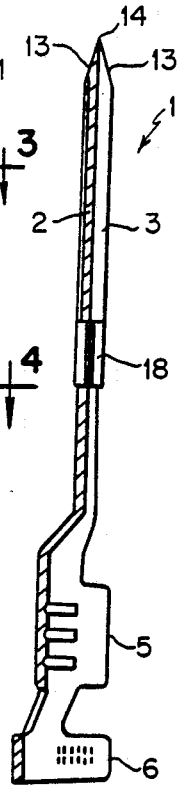
FIG. 2 shows a sectional view of a flat contact spring.
Figure 4:
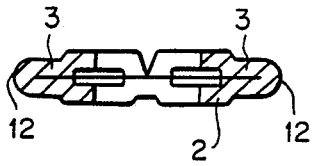
FIG. 4 shows an enlarged view of a cut along line IV—IV in FIG. 1.
Figure 3:
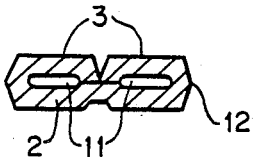
FIG. 3 shows a cut along line III—III in FIG. 1, which is an enlarged view.
Figure 7:
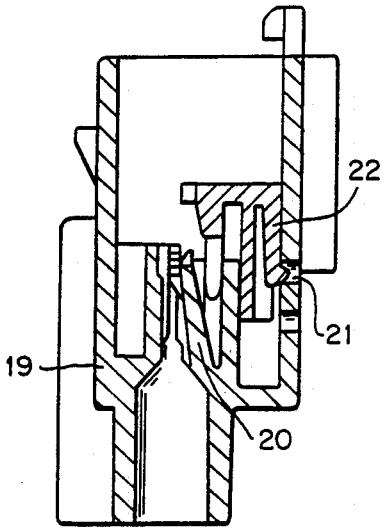
FIG. 7 is a sectional view of a plug casing for a flat contact spring.
Figure 5:
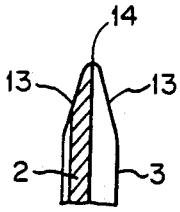
FIG. 5 shows an enlarged, partly sectional view of a flat contact spring.

Spaced from the plugging end, the contact spring tongue 10 has a recess 18 extending through both the center strip 2 and the lateral strips 3. Said recess 18 is produced by openings suitably prepared in the center and lateral strips 2 and 3, respectively, and serves for supporting (FIGS. 7 and 8) a tongue 20, the latter being rigidly joined with the plug casing, when the flat contact spring 1 is inserted in a plug casing 19. Said tongue 20 itself effects axial fixing of the flat contact spring 1 in the plug casing 19. A slide 20 inserted in the plug casing 18, said slide being fixed by means of a tongue 22 engaging a recess 21, prevents the tongue 20 from unintentionally bending back and holds the flat contact spring 1 unmovably in the plug casing 19.

It is obvious that by arranging the metal sheet cuts 7 for the flat contact spring 1 on an edge strip 8, handling of the flat contact springs is significantly facilitated throughout the time of its manufacture.

We claim:

1. A flat contact spring for plugs of electric plug connectors with socket bodies having socket contacts comprising a center strip having crimp attachments arranged axially with a spacing from the center strip;

lateral strips arranged on both sides of the center strip and foldable onto the center strip, said lateral strips having substantially half of the width of the center strip;

said center strip having two indentations extending parallel to each other in the lengthwise direction with a spacing between said indentations;

each of said two lateral strips having one indentation;

and the indentations of the center strip and the two lateral strips when folded are disposed one on top of the other, jointly forming two chambers closed all around.

2. The flat contact spring as defined in claim 1, wherein the center strip has a bevel at a free end;

each of the two lateral strips has a bevel at a free end; and each bevel extending on the outside and sloped against the other toward the free end thereof.

3. A flat contact spring as defined in claim 1, wherein the center strip has a cutout and the lateral strips each has a cutout; and the center strip cutout and the lateral strip cutouts complementing one another to form a common recess for receiving a catch member rigidly shaped on the plug.

4. A flat contact spring as defined in claim 1, further comprising crimp attachments; and wherein the center strip, the two lateral strips and the crimp attachments are formed by one common metal sheet cut to size; and the center strip, with the end facing the crimp attachments is cut with additional metal sheets cut to the same size on a marginal strip.

5. A flat contact spring as defined in claim 1, wherein the center strip has a free end, and the two lateral strips each has a free end; and said center strip and said two lateral strips are rigidly connected with each other at the free end.

6. A flat contact spring as defined in claim 5, wherein the free ends of the two lateral strips and the free end of the center strip are joined with the zone of the plane of separation of the two lateral strips.

7. A process for producing a contact spring having a center strip, two lateral strips with one on each side of the center strip, and crimp attachments comprising jointly cutting the center strip with the crimp attachments and the two lateral strips with a marginal strip from one plane sheet metal part;

simultaneously producing indentations in the center strip and in the two lateral strips;

folding the two lateral strips onto the center strip;

bending the crimp attachments upwardly;

bevelling the center strip and the two lateral strips on the outside of their free ends; and joining these strips to each other by welding, soldering or glueing.

* * * * *